United States Patent [19]

Hauber

[11] 4,208,068

[45] Jun. 17, 1980

[54] SLIDING DOOR LOCK

[75] Inventor: Peter F. Hauber, Burbank, Calif.

[73] Assignee: Reflectolite Products, Inc., Sun Valley, Calif.

[21] Appl. No.: 661,709

[22] Filed: Feb. 26, 1976

[51] Int. Cl.[2] ..... E05C 19/10

[52] U.S. Cl. ..... 292/126; 292/226

[58] Field of Search ..... 292/126, 123, 124, 224, 292/226, 229, 129; 70/100

[56] References Cited

U.S. PATENT DOCUMENTS

| | | | |
|---|---|---|---|
| 3,025,693 | 3/1962 | Braginetz | 292/126 |
| 3,563,068 | 2/1971 | Dushane, Jr. | 292/129 |

*Primary Examiner*—Kenneth Dorner

*Attorney, Agent, or Firm*—John E. Wagner

[57] ABSTRACT

A sliding door lock assembly providing the feature of automatic unlatching if closed when in a latched position along with effective normal operation and burglar resistance. It employs a latch member spring biased to an open position and cammed into a closed or latched position by a lever member. If the latch is in a locked position and is impacted with the door frame upon closing, it is translated and moves the locking lever to an unlocked position. The locking lever includes a jaw portion which engages the latch effectively. The latch is generally T shaped with the head of the T within the housing of the assembly.

4 Claims, 12 Drawing Figures

SLIDING DOOR LOCK

BACKGROUND OF THE INVENTION

A well established replacement for the conventional wooden, hinged door is the horizontally sliding glass door with metal frames. Such doors have architectural advantages in numerous applications since they blend with modern decors and provide expansive viewing area by virtue of the minimum interference resulting from the use of narrow metal door frame & stiles. Another advantage of sliding doors is that they protrude only slightly into the living area when open and thus are particularly well adapted in areas where a door may be open for extended periods of time, such as an entrance to a garden or patio.

One perpetual need of this type door is an improved locking device which will be attractive, unobtrusive, burglar resistant and will not be capable of accidently locking an absent-minded user out of the living area. Typical prior art locks include a hook like member secured in the door stile which may be rotated to engage a lip or pin in the outer frame to lock the door to the frame. Such a lock can often be easily opened by inroducing a shim into the crack between the door stile and the outer frame and lifting the hook. Alternately, the lock can be forced open by prying between the door and the frame and breaking the pin securing the hook or forcing the hook to disengage the lip in the outer frame which is possible as a result of the inherently limited contact area.

Another type of lock in use involves a spring loaded plunger secured to the door stile which engages a track in the outer frame. This lock can likewise often be opened by a shim used to overcome the force of the spring and some types have the additional disadvantage of being able to be closed and locked from the outside, thereby possibly locking an unwitting user outside.

Other types of locks such as cam locks, typically is use with sliding doors having larger wooden frames, extend into the view area of the glass portion of a metal framed door, or are otherwise unattractive.

BRIEF DESCRIPTION OF THE INVENTION

Given the foregoing background, it is the principal object of this invention to provide an improved lock for sliding doors.

A more specific object is to provide a locking device which is substantially burglar proof.

Another object is to provide a locking device which cannot be accidentally engaged merely by closing the sliding door.

These objects are accomplished in accordance with this invention which includes an elongated body or housing and integral handle secured to a door stile. The lock comprises a latch having an elongated interlock or hook portion protruding from the housing via an elongated opening. The latch is substantially T shaped with the head of the T on the inside of the housing. The T shaped latch incorporates a fulcrum portion which allows the interlock portion to pivot and engage a lip of the outer frame. The locking control member is a cam lever rotatably secured in the housing and rotating about a pin extending normal to the attachment surface of the housing. The cam lever has a jaw like contoured surface.

Spring means urge the latch normally into an unlocked position. The latch is not only pivotal but translatable into the housing if imparted by the door when in a locked position. Such translational movement releases the locking lever automatically. The cam lever, when in jaw like grasping contact with the T shaped latch when locked, is such that the latch is retained in interlocking relationship with the outer frame.

BRIEF DESCRIPTION OF THE DRAWINGS.

The foregoing brief description of the invention may be more fully understood with the following detailed description and by reference to the drawings in which.

Figure 5:
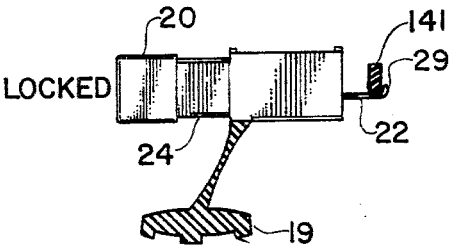
FIG. 5 is a top view similar to FIG. 4 showing the lock in the interlocking position.
Figure 8:
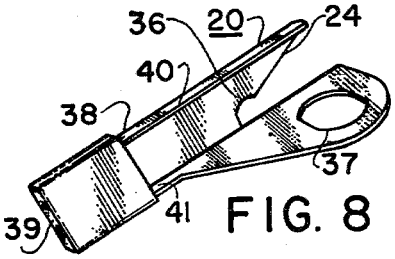
Figure 9:
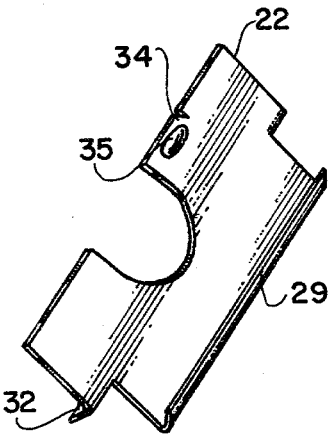
Figure 10:
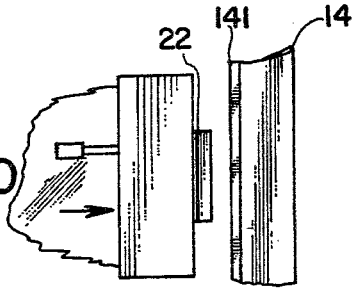
Figure 11:
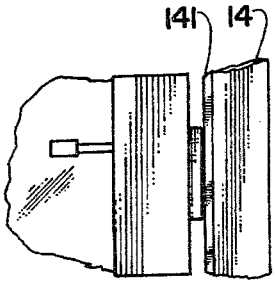
Figure 12:
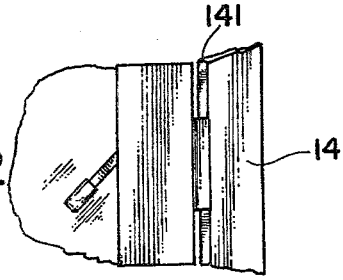

FHG. 7 is a simpkified olan view similar to FIG. 5 showimg the lockimg ldvdr and lasch in a locked position;

FIG. 8 is a perspective view of the cam lever of this invention;

FIG. 9 is a perspective view of the T shaped latch of this invention;

FIGS. 10–12 constitute a series of sequence diagrams of a door being closed with the latch in a locked condition; and FIG. 13 is a fragmentary perspective view of the locking mechanism of this invention in locked condition.

DETAILED DESCRIPTION OF THE INVENTION

Figure 1:
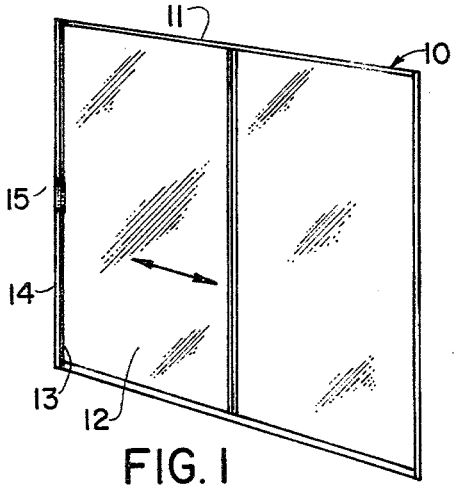
FIG. 1 is a perspective view of a sliding metal frame door employing this invention.

Now refer to FIG. 1 in which a metal frame door, generally designated 10, may be seen. It includes an outer frame 11 containing horizontal tracks at the top and bottom and unshown in the drawing in which an openable door unit 12 may slide. The door unit 12 includes a stile 13 which appears in contact with an outer frame member 14 when the door is closed as in FIG. 1. The door unit 12 is opened and closed from the interior and held locked by a handle and lock assembly 15, better seen in FIG. 2 and succeeding figures of the drawing. The handle and lock assembly 15, when engaged with the frame 14, serves to prevent the door from being opened from the opposite side.

Figure 2:
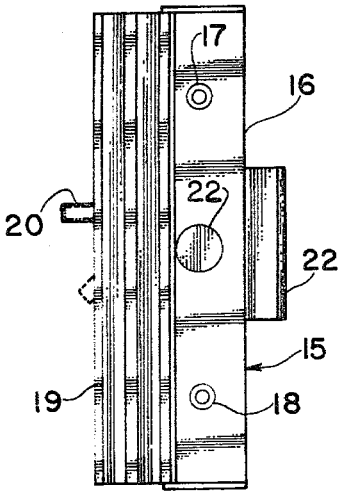
FIG. 2 is a side elevational view of the locking mechanism of the door of FIG. 1 when in a locked position.

New referring to FIG. 2 specifically, the lock assembly 15 may be seen to include a body or housing 16 which may be attached to the door stile 13 of FIG. 1 by screws passing through openings 17 and 18 and threadedly engaging corresponding holes in the unshown door stile. The body or housing 16 may be seen to include an integral door handle 19, also shown in FIGS. 3, 4 and 5, used to open and close the door. Also visible is a portion of the locking cam lever 20, better seen in FIGS. 3, 7 and 8, which is allowed to rotate about a pin 21, the head of which is visible in FIG. 2. An end hook portion of a latch member 22, better seen in FIGS. 3, 7 and 9, can be seen protruding from the housing 16. The body or housing 16 is preferably of no larger dimension than the door stile to which it is attached and thus will not substantially obstruct the view through the glass portion of the door. The locking cam lever 20 is shown in its locked position and in phantom in its unlocked position.

Figure 3:
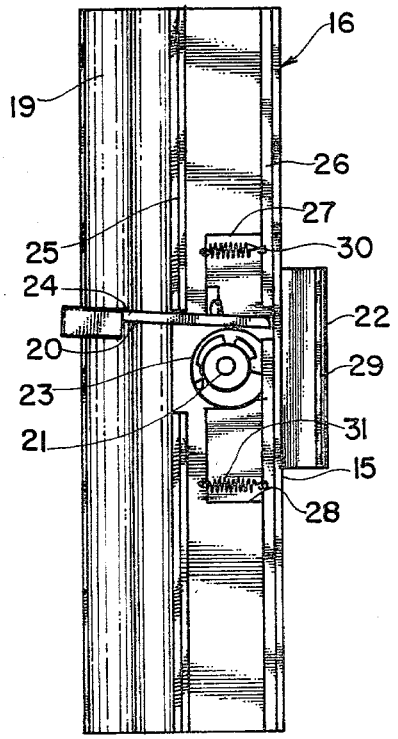
FIG. 3 is a rear side elevational view of the locking mechanism of this invention.

Now referring to FIGS. 3 and 13, the greater detail of the handle lock assembly 15 may be seen, and particularly the location within the housing 16 of the T shaped latch 22 and the cam lever 20. The pin 21 can be seen passing through the cam lever 20 and a circlip or similar retainer 23 is shown residing within an unshown groove in the pin 21. This arrangement serves to hold the cam lever 20 in place while allowing it to rotate. The cam lever 20 is shown rotated in an extreme clockwise direction where it is restrained by contact between the inner side wall 25 of the housing 16 and a lip 24 of the cam lever 20.

The T shaped latch member 22 can be seen in FIGS. 3 and 13 passing freely through an elongated opening unshown in FIG. 3 the outer side wall 26 of the housing 16. The T shaped member 22 is shown to have two generally symmetrical rectangular arm portions 27 and 28 which extend along the inner side of wall 26 and thus contact the side wall 26 across an elongated area. This contact area acts to hold the T shaped member 22 securely within the housing 16 and is structurally sufficient to withstand prying forces which may be encountered during an attempted burglarizing of the lock. The T shaped member 22 can also be seen to have a lip 29 which serves to engage an unshown lip in the outer frame 14 of FIG. 1. The interlock lip 29 is elongated and thus also capable of withstanding severe prying forces. The T shaped member 22 is shown to have a clearance surrounding the cam lever 20 to prevent interference with rotation and to allow access to the circlip 23 for assembly and disassembly. Also visible in FIG. 3 are two springs 30 and 31 which are each attached to both the T shaped member 22 and the outer side wall 26 and whose function is explained with reference to FIG. 6.

Figure 4:
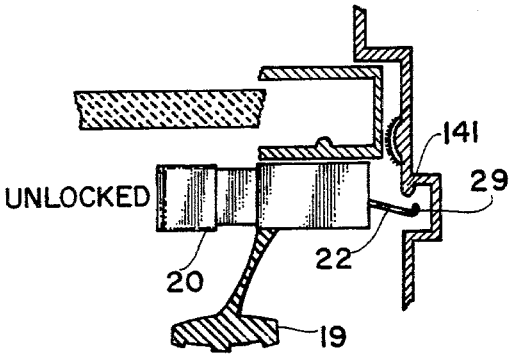
FIG. 4 is a top view of the locking mechanism showing the lock in the noninterlocking position.

Now referring to FIGS. 4 and 5, the action of the interlock lip 29 can be seen in cooperation with the cam lever 20. FIG. 4 shows the lip 29 drawn away from any interlocking engagement with rib 141 of frame 14. On the other hand, FIG. 5 shows the cam lever 20 in a horizontal (locked) position as was shown in FIG. 3 where it was seen to have been rotated in a clockwise direction. With the cam lever 20 so positioned, the interlock lip 29 is shown to be in an interlocking position. Correspondingly, while more readily apparent in FIGS. 2 and 6, FIG. 5 shows the cam lever 20 to be horizontal as in FIG. 2.

Figure 6:
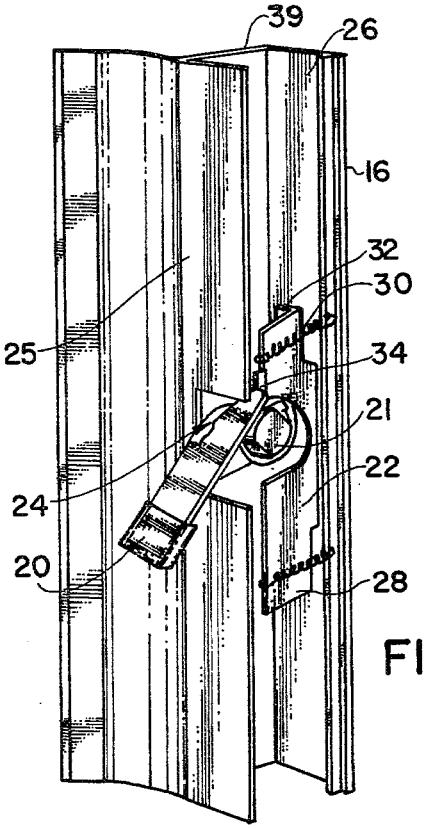
FIG. 6 is a perspective view similar to FIG. 3 showhmf shd kobk hm shd mom$hmsdqkobkhmf ooshshon.

Now referring to FIG. 6, the interaction between the cam lever 20 & the T shaped latch member 22 can be clearly seen. The T shaped member 22 is shown to have a pair of integral lips 32 and 33, one of which 32 appears in contact with the inside wall 39 of the housing 16. The lip 32 and its corresponding part at the bottom of member 22 form a fulcrum. Free to rotate about this fulcrum 32, the T shaped member 22, when unlocked, is constrained in one direction by contact with the contour surface of the jaw 24 of the cam lever 20 and in the other direction by the door frame (unshown in FIG. 6.) The two springs 30 and 31 serve to hold the T shaped member 22 and the contour jaw 24 in contact. In FIG. 6 the cam lever 20 is shown rotated in an extreme counter clockwise direction and prevented from further rotation in that direction by contact with the inner side wall 25. So positioned, the widest portion of the contoured jaw 24 is in contact with the T shaped member 22, thus representing the maximum rotation in one direction, of the T shaped member about its fulcrum 32, resulting in the unshown interlock lip 29 assuming the non-interlock position of FIG. 4. It can further be seen from FIG. 6 that rotation of the cam lever 20 in a clockwise direction, toward the position shown in FIG. 3, will result in movement of the T shaped member 22 along the contour of jaw 24 of the cam lever 20, resulting in a corresponding movement of the interlock lip 29 until it assumes the interlocking position shown in FIG. 5.

Figure 7:
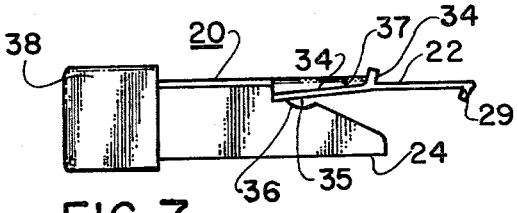

Now referring additionally to FIGS. 7–9, the T shaped member 22 is shown to have an integral surface 35, shown in FIGS. 7 and 9, which incorporates a slope approximating that of the contoured jaws 24 and thus decreasing the frictional resistance between the two contact surfaces while they are in relative motion. These slopes are preferably between 20° and 40° as measured from the housing front 33 in order to allow sufficient rotation of the T shaped membber 22 while providing for minimum friction between the contact surfaces 24 and 34.

Now referring specifically to FIG. 7, the greater details of the engagement between the cam lever 20 and the T shaped member 22 can be seen, and particularly their interlocking relationship. The interlock lip 29 can be seen to be in the interlocking position and the cam lever 20 correspondingly rotated as shown in FIGS. 3 and 5. The T shaped member 22 can be seen to include an integral detent 35 located at the base of the sloped contact surface 34 and better seen in FIGS. 4 and 13 which is surrounded by a corresponding recess 36 at the base of the sloped jaw surface 24 of the cam lever 20. With the detent 35 so located, the jaw 24 of cam lever 20 positively engages the latch member 22 at the surfaces 34 and 35. Lever 20 is held in engaging relationship with the T shaped member 22 by the external spring force described with reference to FIG. 6 and also by an internal spring force supplied by the sloped surface 34 acting against the face 37 of the cam lever. While these spring forces are easily overcome by pressing upon the integral handle 38 of the cam lever, the spring forces are sufficient to overcome gravitational and externally applied forces and thus prevent rotation of the cam lever 20 by any other than an operator standing on the proper side of the door.

It can also be seen that with the cam lever 20 positioned as in FIG. 7, the lip 29 is held securely in an interlocking relationship with the unshown door frame, the contour lip 24 adding sufficient structural rigidity to positively prevent the T shaped member 22 from rotating about its fulcrum 32.

The thickness of the T shaped member 22 is preferably chosen such that it resists bending even by extreme force applied to the T shaped member 22 between the fulcrum 32 and the interlock lip 29 and thus a burglar attempting to disengage the lock by force directed through the crack between the door stile and the outer frame will be unsuccessful.

Now the non-selflocking feature of this invention may be seen by reference to FIGS. 10–12, FIG. 7 and preceding FIGS. 3 and 6.

If the lock is in the interlocking position as shown in FIG. 10 and the door is subsequently closed, it can be seen that lip 29 of latch 22 will contact the rib 141 of the outer frame 14 with which it engages during normal operation. Now referring to FIGS. 3, 7 and 13, a resulting force will be directed against the T shaped member 22 and, if such force is greater than that created by the springs 30 and 31, the T shaped member 22 will be translated and forced away from contact with the outer side wall 26 and toward the inner side wall 25. Referring once again to FIG. 7 as well as FIG. 13, it can be seen that such a translational motion of the T shaped member 22 will create force against the base of the contoured jaw 24 of the cam lever 20 and will result in rotation of the cam lever 20 into the unlocked position shown in FIGS. 6 and 12. Thus, it has been shown that an accidental closing of the door while the lock of this invention is in the locked position will result in much of the force directed against the lock being absorbed by the springs 30 and 31 and, at the same time, the lock will automatically assume the unlocked position. Over years of service, it can be seen that these two simultaneously occuring features will add appreciably to the useful life of the lock since the interlock members and especially the interlock lip 29 are less likely to become bent and distorted.

Referring now to FIG. 8, the greater details of the cam lever 20 can be seen. The handle 38 of the cam lever 20 is shown surrounded by a separate covering 39, preferably of elastomeric composition, so as to provide positive grasping for rotating the cam lever 20 and thereby engaging and disengaging the lock assembly. Integral legs 40 and 41 are shown to extend the length of the handle portion 38 and along side the contour portion 24 to impart structural rigidity and to allow for the use of light weight materials of construction without risking bending.

FIG. 9 illustrates the greater details of the T shaped member 22. The raised portion 35 and the sloped surface 34 cam be seen to be elongated such that perfect alignment with the cam lever of FIG. 8 is not required. The raised portion 35 need not be formed by addition of metal and indeed is preferably formed by stamping as are the interlock lip 29, the integral fulcrum 32 and the sloped contact surface 34.

While variations can be resorted to, both in means and in dimensional relationships, this invention is intended to include all such variations that fall within the scope of the appended claims to this application in which the preferred form only is disclosed.

I claim:

1. A sliding door lock assembly comprising an elongated body for securing a sliding door to a frame;

said body defining an opening adjacent to the frame surface to which the door is to be locked;

a generally T shaped latch member extending through said opening with the head of the T shaped member within said body whereby said latch member is unable to pass through said opening;

said latch member including a hook portion for engaging and locking with the door frame;

said T shaped latch member being mounted for pivotal and translational movement in said body about an axis generally parallel to the direction of elongation of said body whereby said hook portion is rotational into or out of engagement with the door frame;

spring means normally biasing the latch member into unlocked position;

lever means movably secured to said body whereby in one position said lever member engages said T shaped latch to hold said latch in a frame engaging position and movable to a second position wherein said latch is disengaged from the frame;

wherein said latch member spring means biases said T shape against a surface of said body toward the frame whereby an external force applied to said hook portion of said latch member in a direction toward the opening in said body produces translational movement of said latch member against the restraint of said spring members; and said latch member engages said lever means whereby translational movement of said latch member moves said lever to an unlocked position.

2. The combination in accordance with claim 1 wherein said lever is rotatably mounted with respect to said body about an axis generally parallel to the face of said body incorporating said opening wherein said lever means includes a jaw portion which embraces said latch member when said lever means is in a locked position; and wherein said jaw portion restrains said latch member from rotational movement and when in engagement therewith; and wherein said latch member, upon translational movement responsive to force applied to the hook portion of said latch member applies unlocking rotational force to the jaw portion of said lever.

3. The combination in accordance with claim 1 wherein said latch member and lever means include mating detent and recess which are engagable when said lever means is in the locked position.

4. The combination in accordance with claim 1 wherein said latch member includes a pair of ear portions defining a fulcrum for rotation with respect to said body.

* * * * *